US007392007B2

(12) United States Patent
Nakano et al.

(10) Patent No.: US 7,392,007 B2
(45) Date of Patent: Jun. 24, 2008

(54) INTERMEDIATE TRANSFER SYSTEM AND METHOD FOR CLEANING INTERMEDIATE TRANSFER BELT

(75) Inventors: Kuniaki Nakano, Kyoto (JP); Takahiro Fukunaga, Nara (JP); Susumu Murakami, Kyoto (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 662 days.

(21) Appl. No.: 10/967,086

(22) Filed: Oct. 15, 2004

(65) Prior Publication Data

US 2005/0081889 A1 Apr. 21, 2005

(30) Foreign Application Priority Data

Oct. 15, 2003 (JP) ..... 2003-355202

(51) Int. Cl.
*G03G 15/16* (2006.01)
*G03G 21/00* (2006.01)

(52) U.S. Cl. ..... 399/345; 399/101

(58) Field of Classification Search ..... 399/101, 399/120, 345, 350, 351, 358–360
See application file for complete search history.

(56) References Cited

U.S. PATENT DOCUMENTS

2003/0147678 A1 * 8/2003 Ozawa et al. ..... 399/302

FOREIGN PATENT DOCUMENTS

| | | | |
|---|---|---|---|
| JP | 11119619 | A * | 4/1999 |
| JP | 2000-330847 | | 11/2000 |
| JP | 2000-338744 | | 12/2000 |
| JP | 2001-075374 | | 3/2001 |
| JP | 2001-324905 | | 11/2001 |
| JP | 2002-014542 | | 1/2002 |
| JP | 2002-304104 | | 10/2002 |

* cited by examiner

*Primary Examiner*—Ryan Gleitz
(74) *Attorney, Agent, or Firm*—Edwards Angell Palmer & Dodge LLP; David G. Conlin; Peter J. Manus

(57) ABSTRACT

A cleaning blade for removing residual toner left on the surface of an intermediate transfer belt after the second transfer is supported integrally with movement of a tension roller. In the case where the tension roller moves to make a tension of the intermediate transfer belt constant, then, following this, the cleaning blade moves. Thus, the contact state of the cleaning blade with respect to the surface of the intermediate transfer belt is kept constant, and thus cleaning of the intermediate transfer belt can be performed stably.

7 Claims, 6 Drawing Sheets

INTERMEDIATE TRANSFER SYSTEM AND METHOD FOR CLEANING INTERMEDIATE TRANSFER BELT

BACKGROUND OF THE INVENTION

The present application claims priority upon Japanese Patent Application No. 2003-355202 filed on Oct. 15, 2003 under 35 USC 119(a), which is herein incorporated by reference.

The present invention relates to an intermediate transfer system provided in an image forming apparatus using an intermediate transfer technique and a method for cleaning an intermediate transfer belt that is a component member of the intermediate transfer system. In particular, the present invention relates to an improvement to stabilize the cleaning of the intermediate transfer belt.

Conventionally, a color image forming apparatus using an electrophotographic technique such as a color copier or a color printer is provided with a plurality of developing devices, where visible images (toner images) having a different color from developing device to developing device are formed, and eventually these toner images are superimposed and transferred on one and the same recording sheet.

A technique using an intermediate transfer belt (in general, referred to as "intermediate transfer technique") is known as one embodiment of the color image forming apparatus of this type. In the intermediate transfer technique, a developing apparatus for each color is provided, and an optical image obtained by splitting an image into different color components is formed on a photosensitive drum as an electrostatic latent image for each color. Then, the electrostatic latent image is developed to provide a toner image for each color. Then, the respective toner images are superimposed on the same area of an intermediate transfer belt for first transfer, so that a synthesized image of full color is obtained on the intermediate transfer belt, and then the synthesized image is transferred on a recording sheet at one time for the second transfer. Furthermore, when forming monochrome images, a black toner image is first transferred on the intermediate transfer belt using only the developing device corresponding to black images, and the black toner image is secondly transferred on a recording sheet. For example, JP2000-338744A, JP2001-324905A, JP2002-14542A, and JP2002-304104A are known to disclose the image forming apparatus of this type.

A conventional intermediate transfer system provided in an image forming apparatus using such an intermediate transfer technique will be described below.

In a conventional intermediate transfer system as shown in FIG. 9, an intermediate transfer belt c is suspended over a driving roller a and a driven roller b, and a tension roller d for applying a constant tension to the intermediate transfer belt c is pressed onto the inner face of the intermediate transfer belt c. This tension roller d is provided movably, and the tension of the intermediate transfer belt c can be kept constant by the movement thereof even if the state in which the belt is suspended over each roller is changed. Furthermore, this intermediate transfer system is provided with a cleaning blade e for collecting residual toner that is left on the surface of the intermediate transfer belt c after the second transfer onto a recording sheet, and an opposing roller f is provided on the inner face of the intermediate transfer belt c that is opposed to the cleaning blade e. In other words, the intermediate transfer belt c is sandwiched between the cleaning blade e and the opposing roller f, and a frictional force is applied between the outer surface of the intermediate transfer belt c and the cleaning blade e so that the residual toner can be collected. Furthermore, a screw g for conveying toner is provided in the vicinity of the cleaning blade e, and the residual toner collected by the cleaning blade e is conveyed and discharged by the screw g.

Photoreceptors h, h, . . . are provided for respective colors, opposed to the outer surface of the intermediate transfer belt c, and rollers for the first transfer i, i, . . . are provided on the inter face of the intermediate transfer belt c, opposed to the corresponding photoreceptors h, h, . . . . Each roller for the first transfer i is movable in the direction in which the roller for the first transfer i can be in contact with or apart from the photoreceptor h. In a standby time, as shown in FIG. 9A, the roller for the first transfer i have receded from the photoreceptors h. Thus, the outer face of the intermediate transfer belt c is away from the photoreceptors h, h, . . . When forming color images, as shown in FIG. 9B, each of the rollers for the first transfer i, i, advances toward the photoreceptor h, h, . . . Thus, the outer face of the intermediate transfer belt c is brought in contact with each of the photoreceptors h, h, . . . so as to be ready for the first transfer. At the time of forming monochrome images, only the roller for the first transfer i of the developing device that corresponds to black images advances toward the photoreceptor (photoreceptor for black images) h, and thus the outer face of the intermediate transfer belt c is brought in contact with the photoreceptor h for black images so as to be ready for that first transfer (transfer of monochrome images). Furthermore, the suspension state of the intermediate transfer belt c is changed with such movement of the rollers for the first transfer i, i, . . . , so that the belt tension is changed. However, the tension roller d is moved (in the horizontal direction) in FIG. 9, so that a constant tension is applied to the intermediate transfer belt c.

In the structure as described above in which the tension roller d is moved to provide a constant tension to the intermediate transfer belt c, the inclination angle of the span of the intermediate transfer belt c between the tension roller d and the cleaning blade e is varied with the position to which the tension roller d is moved (in the state of FIG. 9A, the inclination angle is large, and in the state of FIG. 9B, the inclination angle is small. As a result, the angle at which the surface of the intermediate transfer belt c is in contact with the cleaning blade e is changed, or the force with which the cleaning blade e is pressed onto the surface of the intermediate transfer belt c is changed, and therefore stable cleaning performance may not be obtained. Consequently, residual toner is left continuously on the surface of the intermediate transfer belt c and this residual toner may be attached to the recording sheet so that the image quality may be affected adversely, or the residual toner may drop from the intermediate transfer belt c to soil the internal portion of the apparatus.

The present invention is carried out in view of these aspects, and the object thereof is to provide an intermediate transfer system that can avoid the state in which residual toner is left continuously on the surface of an intermediate transfer belt by cleaning the intermediate transfer belt stably and a method for cleaning an intermediate transfer belt.

SUMMARY OF THE INVENTION

Summary of the Invention

A solution of the present invention taken to achieve the above-described object is as follows. Even if the position of the intermediate transfer belt is varied with the requirements in forming images such as those for color image formation or monochrome image formation (the suspension state to the rollers is changed: the position of the tension roller is changed), the cleaning blade is moved (positional change) so as to follow the positional change. Thus, the state in which the cleaning blade is in contact with the surface of the intermediate transfer belt (contact angle or contact pressure) can be maintained constant.

Means for Solution

More specifically, the present invention is premised on an intermediate transfer system comprising an intermediate transfer belt whose position is changed with image forming requirement, and a cleaning member for removing residual toner left on a surface of the intermediate transfer belt, the intermediated transfer system being configured so as to transfer a first transfer image transferred onto the intermediate transfer belt onto a recording medium for the second transfer. The position of the cleaning member is changed with the positional change of the intermediate transfer belt so that the contact state of the cleaning member with respect to the surface of the intermediate transfer belt is constant regardless of the positional change of the intermediate transfer belt.

This feature makes it possible that when the intermediate transfer belt moves (actually, the state in which the intermediate transfer belt is suspended over the rollers is changed by the movement of the tension roller) in order to keep the tension of the intermediate transfer belt constant during operation for image formation, the position of the cleaning member is changed in synchronization with the movement of the intermediate transfer belt so that the state in which the cleaning member (cleaning blade) is in contact with the surface of the intermediate transfer belt is not changed (so as to be contact with a predetermined cleaning point at a predetermined angle and a predetermined pressure). Therefore, the contact angle and the contact pressure of the cleaning member with respect to the surface of the intermediate transfer belt is constantly kept optimal, and the friction force between the intermediate transfer belt and the cleaning member can be kept constant. Thus, stable cleaning performance can be ensured. Therefore, the situation in which residual toner is continuously left on the surface of the intermediate transfer belt can be avoided, which makes it impossible that the residual toner is attached to a recording sheet so as to affect adversely the image quality, or that the residual toner drops from the intermediate transfer belt to soil the internal portion of the apparatus.

A specific structure to remove and collect the residual toner by the cleaning member can be as follows: The cleaning member is constituted by an elastic rubber blade. On the other hand, a storage portion for storing waste toner collected from the surface of the intermediate transfer belt by this elastic rubber blade is provided. Then, the system comprises a tension roller over which the intermediate transfer belt is suspended and that is provided in a position opposed to the elastic rubber blade, and that can move so as to keep a tension of the intermediate transfer belt constant.

This feature makes it possible that when the state in which the intermediate transfer belt is provided is changed in accordance with the image formation requirement such as for color image formation or for monochrome image formation, the tension roller moves so that the tension is kept constant. An opposing roller opposed to the cleaning member (the elastic rubber blade) is used also as the tension roller that repeats slight movement (vibration) to apply a constant tension to the intermediate transfer belt. Therefore, the collected toner (waste toner) that is collected by the cleaning member can be conveyed to the storage portion efficiently. Moreover, the configuration of the intermediate transfer unit including the roller can be simplified, which leads to a reduction of the cost.

Furthermore, a cleaning unit is provided in a contact portion of the cleaning member with respect to the surface of the intermediate transfer belt, and the cleaning member is provided in the cleaning unit. On the other hand, the cleaning unit is divided into at least two, and a portion that is obtained by the division and is provided with the cleaning member is supported by the tension roller and is configured so as to move in accordance with the positional change of the tension roller.

Thus, the cleaning member can be in contact with the intermediate transfer belt at a predetermined point, angle, and pressure, regardless of the positional change of the intermediate transfer belt, and thus stable cleaning performance can be ensured.

A specific supporting structure of the cleaning unit can be as follows. A portion that is obtained by dividing the cleaning unit and includes the storage portion is supported by a frame member of an image forming apparatus so that the position is fixed.

As the amount of waste toner (the amount of toner that is removed and collected by the cleaning member) increases, the weight of the cleaning unit increases. When the cleaning unit has an integral structure, this weight load acts as a movement load of the tension roller. However, in the means for solution of the present invention, a collecting portion (the storage portion), which is a portion of the divided cleaning unit, is supported by the frame member, so that the weight load does not act as the movement load of the tension roller, and thus the movement load of the tension roller constantly can be kept be a predetermined load.

The coupling structure of the portions of the cleaning unit having a divided structure can be as follows. The portions that are obtained by dividing the cleaning unit are coupled by an elastic member, and the elastic member is constituted as an expandable coupling member. More specifically, this elastic member is constituted by a duct or an accordion-shaped coupling member.

Thus, the portions of the divided cleaning unit are coupled by the elastic member (expandable coupling member), which makes it easy to achieve the structure in which one portion of the divided unit is fixed to the apparatus frame, and the other is movable in synchronization with the positional change of the tension roller.

A structure for optimizing the collection state of the waste toner in the storage portion can be as follows. A uniformizing member is provided in the cleaning member, and one end of this uniformizing member is positioned in the storage portion for smoothing the upper face of waste toner collected in the storage portion.

As the waste toner is collected in the storage portion, the waste toner is accumulated in a mountain shape. Therefore, it is possible that in the state where the volume of the storage portion is not filled yet, the upper face of the waste toner reaches the upper end of the storage portion, so that the waste toner cannot be collected any more. In the means for solution of the present invention, the uniformizing member is held together with the cleaning member (the elastic rubber blade), so that the uniformizing member moves in accordance with the positional change of the tension roller. The movement of the uniformizing member allows the waste toner to be mixed in the storage portion, and the upper surface can be smooth. Thus, the waste toner can be collected to the upper limit of the volume of the collecting portion (the storage portion).

Furthermore, a supporting structure of the tension roller can be as follows. The tension roller is supported by a slot formed in a supporting member, and is movable in the direction in which the slot extends, and is provided with a spring force of a spring for applying a tension to the intermediate transfer belt, and thus the tension roller is configured to make the tension to the intermediate transfer belt whose position is changed in accordance with image forming requirement constant.

Changing the position of the intermediate transfer belt between monochrome printing and color printing is an essential operation in view of the life of the photoreceptors or the like. The movement distance is large at this time, and with this movement, the tension roller provided to apply a constant tension to the intermediate transfer belt moves as well. By making a slot for the supporting hole for supporting the tension roller, the tension roller can move, and by applying an energizing force of a spring to the tension roller, a constant tension can be applied to the intermediate transfer belt.

The position of the intermediate transfer belt is changed by detachment/contact of the intermediate transfer belt from/with a photoreceptor by movement of a roller for the first transfer in accordance with image forming requirement.

A photoreceptor for black is necessary for monochrome printing, and all the photoreceptors are necessary for color printing. In other words, only the photoreceptor for black is necessary for monochrome printing, and the other photoreceptors are not necessary. It is preferable that the photoreceptors are detached from or brought in contact with the intermediate transfer belt in accordance with the printing requirement, in view of the life of the photoreceptors or the like. The movement of the roller for the first transfer allows the photoreceptors to be detached from or brought in contact with the intermediate transfer belt, and thus it is possible to apply a tension change to the intermediate transfer belt.

A specific shape of the tension roller can be as follows. The tension roller is constituted by a roller in which at least a distance in which the intermediate transfer belt is in contact with the cleaning member, preferably a distance in which the tension roller extends across the intermediate transfer belt is straight.

Thus, the tension roller that is in contact with the cleaning member (the elastic rubber blade) is formed of a straight roller, so that the cleaning performance can be uniform. Furthermore, by providing the portions except the contact portion (the portion that is in contact with the cleaning member) with a different shape, the meandering of the intermediate transfer belt involved in the travel of the intermediate transfer belt can be controlled.

A method for cleaning an intermediate transfer belt that is performed by the intermediate transfer system according to each of the above-described means for solution is in the scope of the technical idea of the present invention. The method for cleaning the intermediate transfer belt is as follows: The position of the cleaning member is changed with the positional change of the intermediate transfer belt so that the contact state of the cleaning member with respect to the surface of the intermediate transfer belt is constant regardless of the positional change of the intermediate transfer belt.

As described above, in the present invention, even if the position of the intermediate transfer belt is changed, the cleaning blade is moved (positional change) so as to follow that positional change. Thus, the contact state of the cleaning blade with respect to the surface of the intermediate transfer belt can be kept constant. Therefore, the contact angel and the contact pressure of the cleaning blade with respect to the surface of the intermediate transfer belt can be kept in the optimal state, and the friction force between the intermediate transfer belt and the cleaning member can be kept constant. Thus, stable cleaning performance can be ensured. Therefore, the situation in which residual toner is continuously left on the surface of the intermediate transfer belt can be avoided, which makes it impossible that the residual toner is attached to a recording sheet and affects adversely the image quality, or that the residual toner drops from the intermediate transfer belt to soil the internal portion of the apparatus.

DESCRIPTION OF THE PREFERRED EMBODIMENTS

Hereinafter, embodiments of the present invention will be described with reference to the accompanying drawings.

Figure 1:
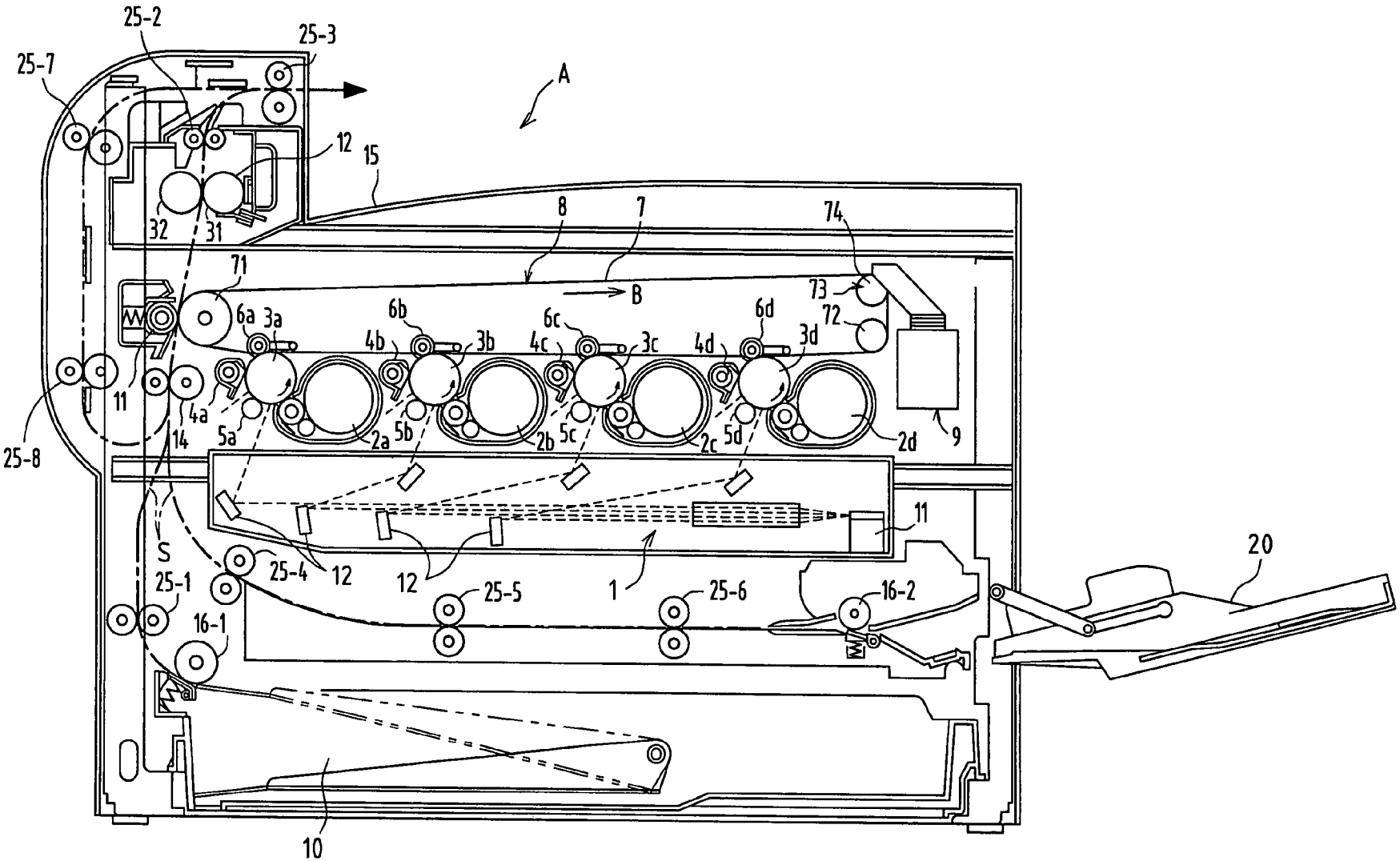
FIG. 1 is a view showing the internal structure of an image forming apparatus according to an embodiment.

FIG. 1 is a view for illustrating the structure of an image forming apparatus A according to this embodiment. The image forming apparatus A forms multicolor (full color) images or single color (monochrome) images on a predetermined sheet (recording sheet) in accordance with image data transmitted from the outside (e.g., an terminal such as a personal computer). As shown in FIG. 1, the image forming apparatus A includes an exposure unit 1, developing devices 2 (2*a* to 2*d*), photosensitive drums (photoreceptors as used in this invention) 3 (3*a* to 3*d*), charging devices 5 (5*a* to 5*d*), cleaning units 4 (4*a* to 4*d*), intermediate belt units 8, fixing units 12, sheet conveying path S, a paper-feeding cassette 10, and a paper-discharge tray 15.

Image data handled by the image forming apparatus A is based on color images employing black (K), cyan (C), magenta (M), and yellow (Y). Therefore, the developing devices 2 (2*a* to 2*d*), the photosensitive drums 3 (3*a* to 3*d*), the charging devices 5 (5*a* to 5*d*), and the cleaning units 4 (4*a* to 4*d*) are provided in the number of four for each that correspond to the respective colors so as to form electrostatic latent images of four kinds. In FIG. 1, for the devices of each type, a corresponds to black, b to cyan, c to magenta, and d to yellow so that four image stations are constituted.

The photosensitive drums 3 are provided (mounted) in an upper portion of the image forming apparatus, and electrostatic latent images in accordance with image data are formed by the exposure unit 1 as described later.

The charging devices 5 are charging means for charging the surfaces of the photosensitive drums 3 uniformly to a predetermined potential, and in addition to roller-type or brush-type of contact type as shown in FIG. 1, charger-type charging devices can be used.

The exposure unit 1 is constituted by a laser scanning unit (LSU) including a laser irradiating portion 11 and reflection mirrors 12, 12, . . . In addition, for example, EL or LED writing heads in which light-emitting elements are arranged in an array can be used. This exposure unit 1 has the function to expose the charged photosensitive drums 3 to light in accordance with image data that have been input so as to form electrostatic latent images in accordance with the image data on the surfaces of the photosensitive drums 3.

The developing devices 2 turn the electrostatic latent images formed on the respective photosensitive drums 3 into visible images with toners of respective colors (K, C, M and Y).

The cleaning units 4 remove and collect the toner that is left on the surfaces of the photosensitive drums 3 after development and image transfer.

The intermediate transfer belt unit 8 provided above the photosensitive drums 3 includes an intermediate transfer belt 7, an intermediate transfer belt driving roller 71, an intermediate transfer belt tension roller 73, an intermediate transfer belt driven roller 72, intermediate transfer rollers 6 (6*a* to 6*d*) serving as rollers for the first transfer and an intermediate transfer belt cleaning unit 9.

An intermediate transfer belt 7 is suspended over the intermediate transfer belt driving roller 71, the intermediate transfer belt tension mechanism 73, the intermediate transfer rollers 6 and the intermediate transfer belt driven roller 72 so that the intermediate transfer belt 7 travels in the direction shown by an arrow B with the rotationally driving of the intermediate transfer belt driving roller 71.

The intermediate transfer rollers 6 are provided rotatably on the inter face of the intermediate transfer belt 7 opposed to the respective photosensitive drums 3, and are supplied with a transfer bias for transferring toner images of the photosensitive drum 3 on the intermediate transfer belt 7.

The intermediate transfer belt 7 is provided so as to be in contact with each of the photosensitive drums 3. Then, the toner images of each color formed on the photosensitive drums 3 are superimposed and transferred sequentially on the intermediate transfer belt 7, so that color toner images (synthesized images of multicolor toner) are formed on the intermediate transfer belt 7. This intermediate transfer belt 7 is formed so as to have no end, using a film having a thickness of about 100 μm to 150 μm.

The transfer of the toner image from the photosensitive drums 3 to the intermediate transfer belt 7 is performed by the intermediate transfer rollers 6 that are in contact with the reverse side (inner face side) of the intermediate transfer belt 7. More specifically, a high voltage transfer bias (high voltage of a polarity (+) that is opposite to the polarity (−) of charged toner) is applied to the intermediate transfer rollers 6. The intermediate transfer rollers 6 are rollers that are based on a metal (e.g., stainless steel) shaft having a diameter of 8 to 10 mm and whose surfaces are covered with a conductive elastic material (e.g., EPDM, urethane foam, etc.). This conductive elastic material allows a high voltage to be applied uniformly to the intermediate transfer belt 7. In this example, a roller-shaped transfer electrode is used, but a brush also can be used.

The toner images that have been turned visible in accordance with each hue on the respective photosensitive drums 3*a* to 3*d* as described above are laminated on the intermediate transfer belt 7 and become image information that has been input to the apparatus. Thus, the laminated image information (synthesized images of multicolor toner) is transferred on a paper sheet by a transfer roller 11 arranged in the contact positions of the intermediate transfer belt 7 and the paper sheet, which will be described later, by the travel of the intermediate transfer belt 7.

At this time, the intermediate transfer belt 7 and the transfer roller 11 are pressed so as to be in contact with each other with a predetermined nip, and a voltage (high voltage of the polarity (+) opposite to the polarity (−) of charged toner) is applied to the transfer roller 11 to transfer toner onto a paper sheet. Furthermore, in order for the transfer roller 11 to obtain the nip constantly, either one of the transfer roller 11 and the intermediate transfer belt driving roller 71 is made of a hard material (metal or the like), and the other is made of a soft material, such as an elastic roller (elastic rubber roller, foam resin rollers or the like).

Furthermore, as described above, toner attached to the intermediate transfer belt 7 by the contact with the photosensitive drums 3 or toner that is left on the intermediate transfer belt 7 instead of being transferred onto a paper sheet by the transfer roller 11 may cause colors to be mixed in the following process, and therefore the system is configured such that the toner is removed and collected by the intermediate transfer belt cleaning unit 9. This intermediate transfer belt cleaning unit 9 is provided with, for example, a cleaning blade 91 (see FIG. 2) as a cleaning member that is in contact with the intermediate transfer belt 7, and the cleaning blade 91 is supported by the tension roller 74 from the back side against the intermediate transfer belt 7 that is in contact with the cleaning blade 91.

The paper-feeding cassette 10 is a cassette for accommodating sheets (recording sheets) used for image formation, and is provided in the lowermost portion of the image forming apparatus A, that is, below the exposure unit 1. The paper-discharging tray 15 provided in an upper portion of the image forming apparatus A is a tray on which printed sheets are to be mounted facedown.

In the image forming apparatus A, a sheet conveying path S for conveying the sheets in the paper-feeding cassette 10 to the paper-discharging tray 15 through the transfer roller 11 and the fixing unit 12 is provided. This sheet conveying path S extends approximately in the vertical direction from the paper-discharging portion of the paper-feeding cassette 10 toward the paper-discharging tray 15. Furthermore, in the sheet conveying path S from the paper-feeding cassette 10 toward the paper-discharging tray 15, a pickup roller 16 (16-1), a registration roller 14, the transfer roller 11, the fixing unit 12, conveying rollers 25 (25-1, 25-2, and 25-3) for conveying the sheet and the like are provided.

The conveying rollers 25 are small rollers for promoting or helping conveyance of the sheet, and a plurality of conveying rollers are provided along the sheet conveying path S. The pickup roller 16 is provided in the end portion of the paper-feeding cassette 10, and is a pull-in roller that supplies a sheet one by one from the paper-feeding cassette 10 to the sheet conveying path S.

Furthermore, the registration roller 14 holds temporarily the sheet that is being conveyed on the sheet conveying path S, and has the function to convey the sheet to a transfer portion (the nip portion between the transfer roller 11 and the intermediate transfer belt driving roller 71) at a timing at which the edge of the toner image on the intermediate transfer belt 7 is matched with the edge of the sheet.

The fixing unit 12 is provided with a heat roller 31, a pressing roller 32 and the like, and the heat roller 31 and the pressing roller 32 are configured so as to be rotated with the sheet sandwiched therebetween. The heat roller 31 is set to be a predetermined fixing temperature by a controller based on signals from a temperature detector (not shown), and has the function to melt, mix and press multicolor toner images transferred onto the sheet so that the images are thermally fixed onto the sheet by subjecting the sheet to thermocompressing bonding in cooperation with the pressing roller 32.

The sheet in which the multicolor toner images are fixed is conveyed on the sheet conveying path S by the conveying rollers 25, . . . and is discharged onto the paper-discharging tray 15 with the multicolor toner image facing downward.

Next, the sheet conveying path will be described more specifically. In the image forming apparatus A, the paper-feeding cassette 10 for accommodating sheets is provided, and a manual tray 20 that eliminates an operation of opening/closing the paper-feeding cassette 10 when the user is to print a few sheets.

A pickup roller 16 (16-1, 16-2) is provided for each of the two paper-feeding methods, and is configured to guide sheets one by one to the conveying path.

The sheets conveyed from the paper-feeding cassette 10 is conveyed to the registration roller 14 by the conveying roller 25-1, and is conveyed to the transfer roller 11 at a timing at which the edge of the sheet is matched with the edge of the image information on the intermediate transfer belt 7, and then the image information is written on the sheet. Thereafter, the sheet passes through the fixing unit 12 so that unfixed toner on the sheet is melted and attached firmly to the sheet and passes through the conveying roller 25-2 and is discharged from the paper-discharging roller 25-3 onto the paper-discharging tray 15 (at the time of one face-printing requirement).

On the other hand, a sheet mounted on the manual tray 20 is fed by the pickup roller 16-2, and reaches the registration roller 14 via a plurality of conveying rollers (25-6, 25-5, 25-4) and thereafter passes through the same path as in the case of the sheets fed from the paper-feeding cassette 10 and is discharged to the paper-discharging tray 15 (at the time of one face printing requirement).

At this time, in the case of two face-printing requirement, the rear end of the sheet that has passed through the fixing portion 12 after one face-printing is completed is chucked by the paper-discharging roller 25-3, and is guided to the conveying rollers (25-7, 25-8) by the paper-discharging roller 25-3 rotating in the reverse direction. Thereafter, the sheet passes through the registration roller 14, is printed on it back face, and then is discharged to the paper-discharging tray 15.

Next, the characteristic portions of the intermediate transfer belt unit 7 as an intermediate transfer system provided in the above-described image forming apparatus A will be described with reference to FIGS. 2 to 8.

Figure 2:
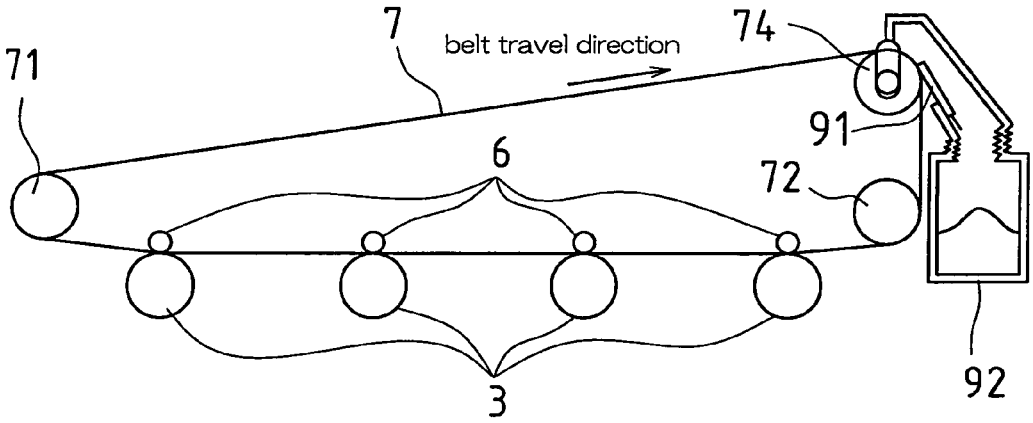
FIG. 2 is a view showing a schematic structure of the intermediate transfer belt unit.

First, in FIG. 2, the tension roller 74 for supplying a constant tension to the intermediate transfer belt 7 is opposed to the cleaning blade 91 for collecting residual toner on the intermediate transfer belt 7, and supplies a friction force between the intermediate transfer belt 7 and the cleaning belt 91 so that a pressure for cleaning is applied. The residual toner on the intermediate transfer belt 7 is collected at the contact point between the belt 7 and the blade 91 due to the travel of the belt 7. The collected residual toner drops onto a storage portion 92 provided below the cleaning blade 91 and is accumulated there. Here, the tension roller 74 repeats slight movement constantly in the moving direction with the travel of the intermediate transfer belt 7, so that the waste toner that stays at the contact point between the cleaning blade 91 and the tension roller 74 can be allowed to drop onto the storage portion 92 efficiently by this vibration.

Next, the positional relationship between the intermediate transfer belt cleaning unit 9 and the tension roller 74 in color mode, monochrome mode, and standby will be described more specifically with reference to FIGS. 3 to 5.

In order to reduce deterioration of the photosensitive drums 3 due to contact between the intermediate transfer belt 7 and the photosensitive drums 3, the intermediate transfer rollers 6 are moved in accordance with the printing requirement, and the intermediate transfer belt 7 and the photosensitive drums 3 can be brought in contact with or detached each other with this movement. The printing requirement includes color printing and monochrome printing, and the states at these times are shown in FIG. 3 (color mode) and FIG. 4 (monochrome mode). FIG. 5 shows the state at the time of non-printing (standby).

The tension roller 74 provided to apply a constant tension to the intermediate transfer belt 7 moves significantly with the movement of the intermediate transfer rollers 6 in accordance with the printing requirement. At this time, if the position of the cleaning unit is fixed as in the conventional example, the position angle between the cleaning blade and the intermediate transfer belt is changed, so that cleaning performance is changed.

Figure 6:
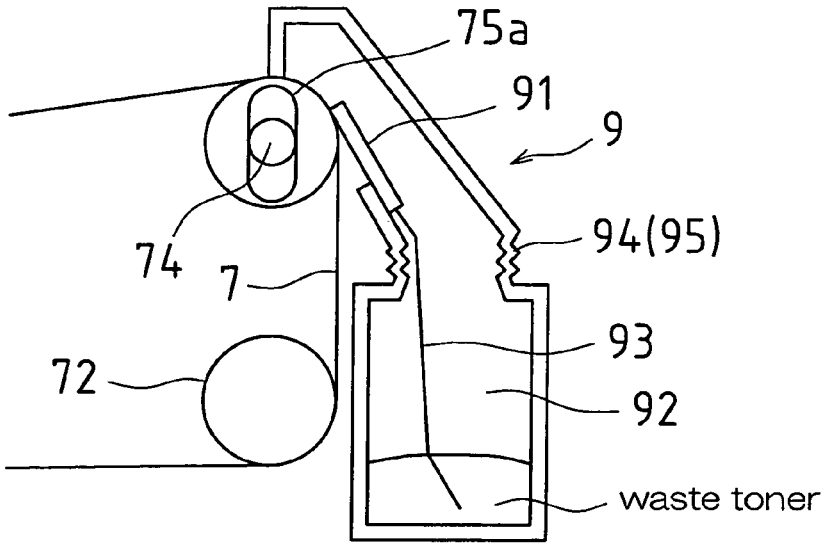
FIG. 6 is a view showing a schematic structure of an intermediate transfer belt cleaning unit and a peripheral portion thereof.

On the other hand, in this embodiment, as described below with reference to FIG. 6, since the cleaning blade 91 is supported by the tension roller 74, a change in the cleaning performance due to a change in the position angle can be prevented, and stable cleaning performance can be ensured.

Furthermore, a uniformizing member 93 is supported by the cleaning blade 91, and the uniformizing member 93, as well as the cleaning blade 91, moves with the movement of the tension roller 74. This movement supplies vibration to the waste toner contained in the storage portion 92, so that the upper face of the waste toner can be smooth. In the case where the uniformizing member 93 is not provided, as shown in FIG. 2, the waste toner is accumulated to be in a mountain shape. The smoothing of the waste toner can prevent containment failure at the point when the amount of the waste toner does not yet reach the volume of the storage portion 92.

Furthermore, the intermediate transfer belt cleaning unit 9 will be described more specifically with reference to FIG. 6. The intermediate transfer belt cleaning unit 9 includes the cleaning blade 91 (elastic rubber blade) for colleting residual toner on the intermediate transfer belt 7, an elastic member 94 (in general, an accordion-shaped member), a waste toner storage portion 92 for storing residual toner collected by the cleaning blade 91, and the uniformizing member 93 for smoothing the contained waste toner.

The cleaning unit 9 is divided into at least two portions, and one portion (upper portion) that is divided is supported by the tension roller 74 and moves in accordance with the position movement of the tension roller 74.

One portion (lower portion) including the storage portion 92 of the divided cleaning unit 9 is supported by the apparatus frame so that its position is fixed.

The thus divided upper and lower portions of the cleaning unit 9 are coupled by the elastic member 94. More specifically, the elastic deformation of the elastic member 94 allows the upper portion of the cleaning unit 9 to move relatively to the lower portion.

The uniformizing member 93 is held together with the cleaning blade 91 or the like, and its edge (lower edge) portion extends to the storage portion 92, and smoothes the upper face of the collected waste toner.

Figure 7:
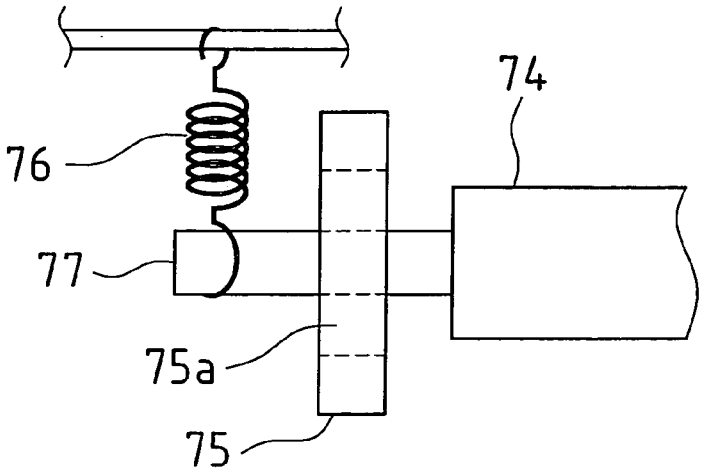
FIG. 7 is a view showing the supporting structure of the shaft end portion of a tension roller.
Figure 8:
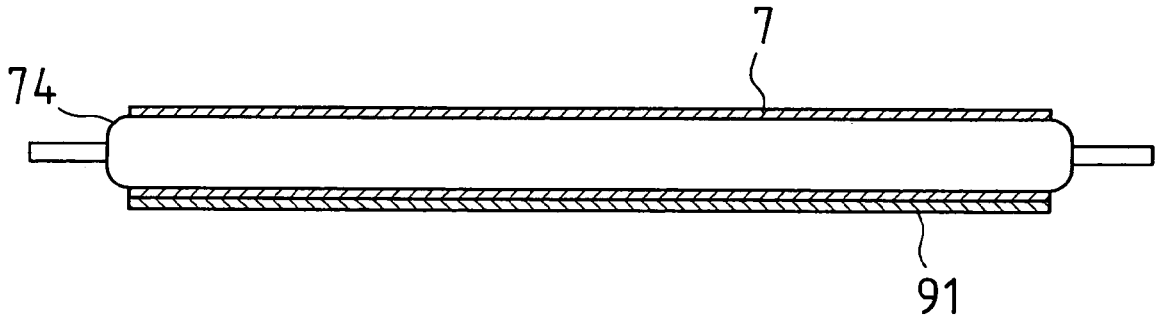
FIG. 8 is a cross-sectional view of the peripheral portion of the tension roller that is viewed from the direction orthogonal to the shaft center.
Figure 9:
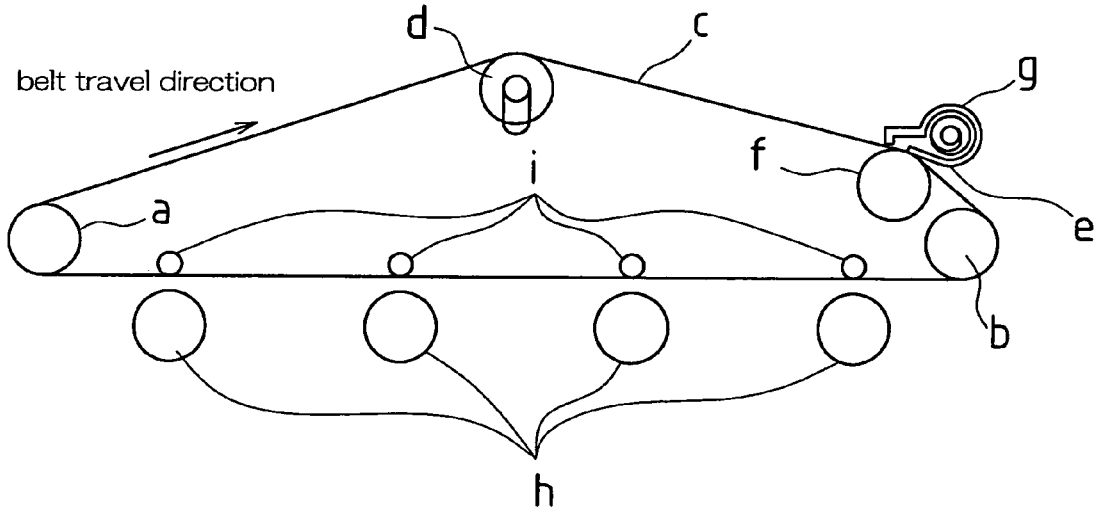
FIG.9 (a) Prior Art
FIG. 9A is a view showing a schematic structure of a conventional intermediate transfer system at standby time.
FIG. 9B is a view showing a schematic structure of the conventional intermediate transfer system when forming color images.
Figure 9:
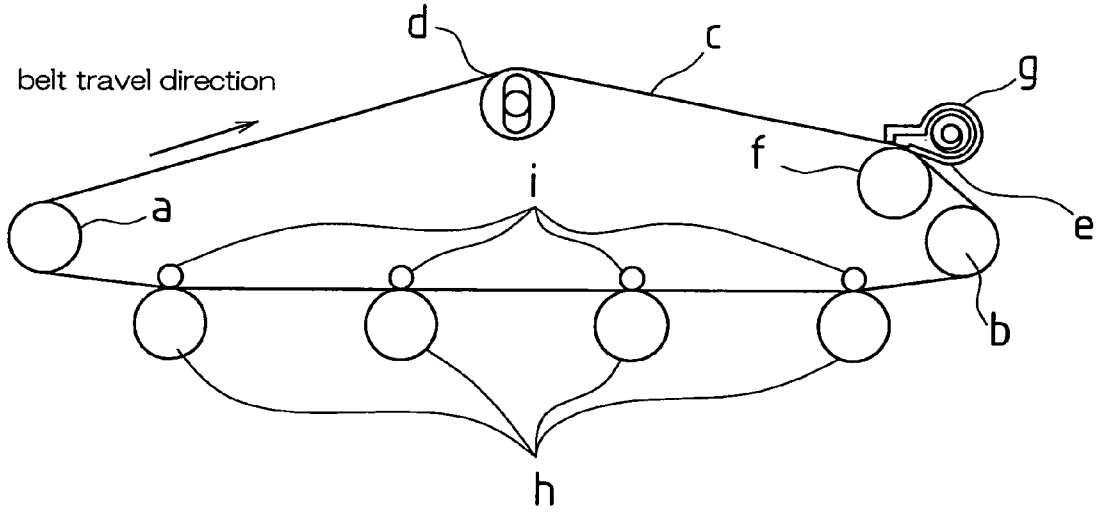
FIG.9 (b) Prior Art

Furthermore, the positional relationship and the movement relationship between the cleaning blade 91 and the tension roller 74 in the above description will be described more specifically with reference to FIGS. 7 and 8.

A supporting portion 75 that supports the tension roller 74 provided to apply a constant tension to the intermediate transfer belt 7 is constituted so as to include a slot roller bearing 75*a*, and a tension spring 76 is provided in the end portion of the tension roller 74. This tension spring 76 allows a constant tension to be applied constantly to the intermediate transfer belt 7 regardless of the printing requirement.

Figure 3:
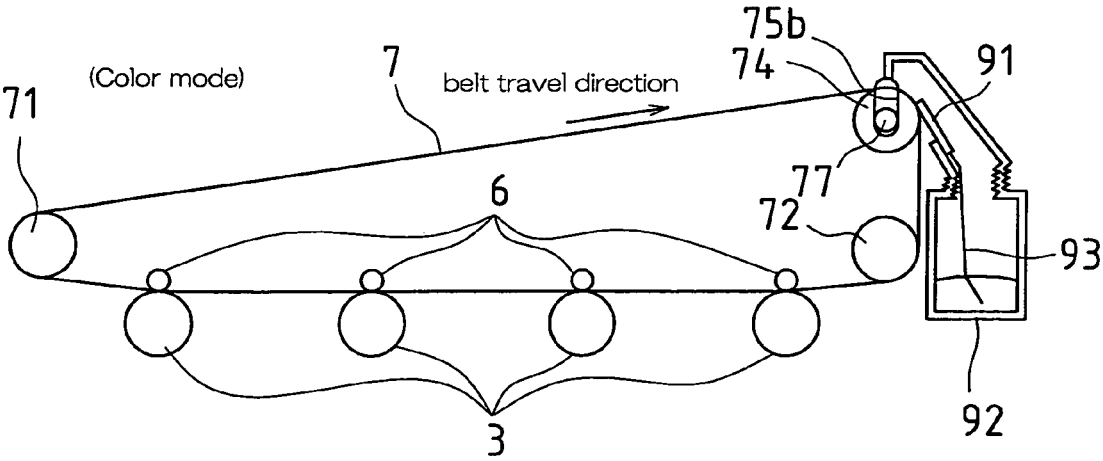
FIG. 3 is a view showing a schematic structure of the intermediate transfer belt unit in color mode.

In color mode, as shown in FIG. 3, a tension roller shaft 77 is moved to a lower portion of the support hole 75*b* of the roller bearing 75*a*, and in synchronization with this, the cleaning blade 91 supported by the tension roller 74 also moves to the lower portion. At this time, the juncture portion 95 of the cleaning unit 9 divided into at least two that is constituted by the elastic member 94 (accordion-shaped member) is compressed.

Figure 4:
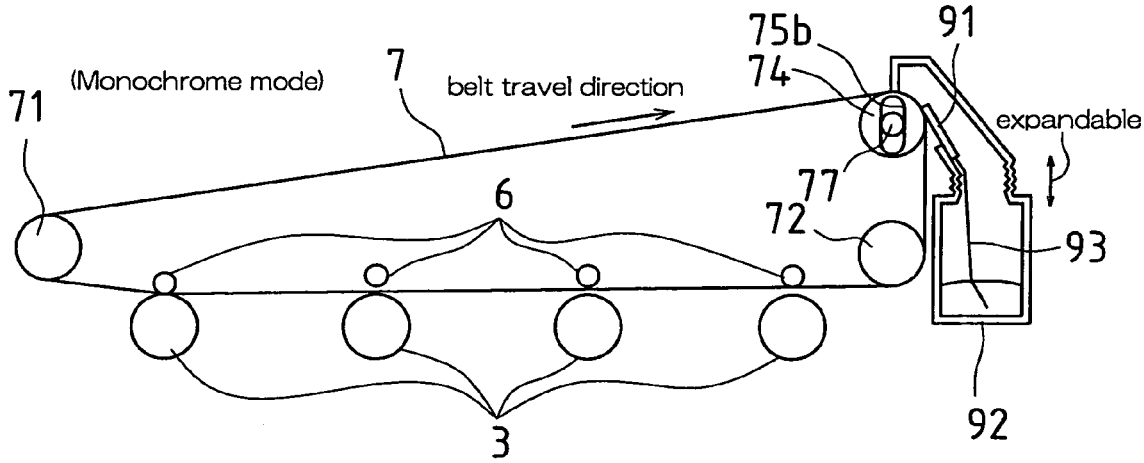
FIG. 4 is a view showing a schematic structure of the intermediate transfer belt unit in monochrome mode.
Figure 5:
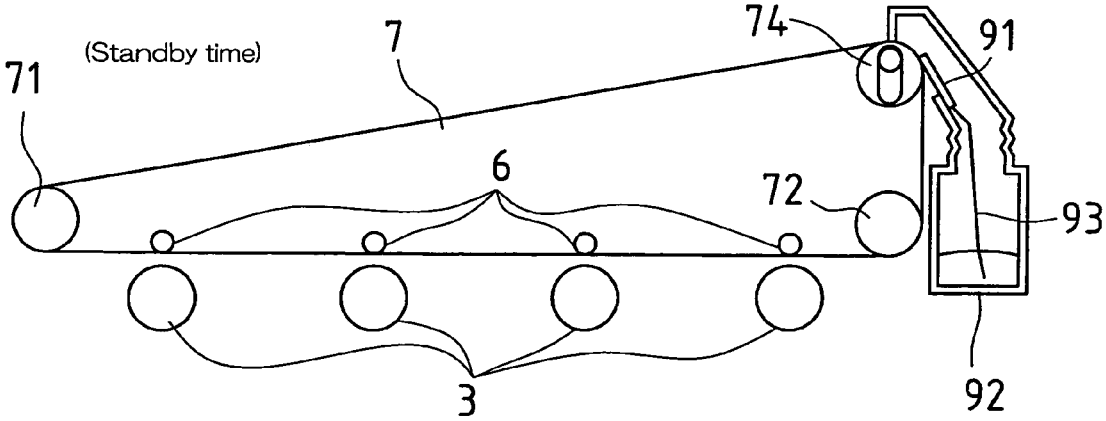
FIG. 5 is a view showing a schematic structure of the intermediate transfer belt unit at standby time.

In monochrome mode, as shown in FIG. 4, a tension roller shaft 77 is moved to an upper portion of the support hole 75*b*, and in synchronization with this, the cleaning blade 91 supported by the tension roller 74 also moves to the upper portion. At this time, the juncture portion 95 that is constituted by the elastic member 94 (accordion-shaped member) of the cleaning unit 9 divided into at least two is extended.

The shape in the longitudinal direction of the tension roller 74 in the above description will be described below with reference to FIG. 8.

The tension roller 74 provided to apply a constant tension to the intermediate transfer belt 7 has such a shape that at least the distance in which intermediate transfer belt 7 is in contact with the cleaning blade 91 for collecting residual toner, preferably the distance in which the tension roller 74 extends across the intermediate transfer belt 7 is straight.

As described above, in this embodiment, the following effects can be provided by synchronizing the movement of the tension roller 74 with the movement of the cleaning blade 91 of the divided cleaning unit 9 in color mode and in monochrome mode.

(1) A constant blade contact angle can be obtained.

(2) The waste toner can be collected in the storage portion 92 efficiently.

(3) The storage volume for waste toner can be utilized efficiently.

In addition to obtaining these effects, the movement of the tension roller 74 and the movement of the cleaning unit 9 due to the detachment/contact of the intermediate transfer belt 7 can be facilitated. Furthermore, the present invention contributes to compact design of the apparatus and reduction in the cost.

Other examples

In each example described above, the cases in which the present invention is applied to an image forming apparatus A constituted as a color printer have been described. The present invention is not limited thereto, and can be applied to an image forming apparatus constituted as a color copier or an image forming apparatus constituted as a compound device having a plurality of functions.

The invention may be embodied in other forms without departing from the spirit or essential characteristics thereof. The embodiments disclosed in this application are to be considered in all respects as illustrative and not limiting. The scope of the invention is indicated by the appended claims and is not bound to the foregoing description, and all changes which come within the meaning and range of equivalency of the claims are intended to be embraced therein.

What is claimed is:

1. An intermediate transfer system comprising an intermediate transfer belt whose position is changed with image forming requirement, and a cleaning member for removing residual toner left on a surface of the intermediate transfer belt, the intermediate transfer system being configured so as to transfer a first transfer image transferred onto the intermediate transfer belt onto a recording medium for second transfer, wherein a position of the cleaning member is changed with the positional change of the intermediate transfer belt so that the contact state of the cleaning member with respect to the surface of the intermediate transfer belt is constant regardless of the positional change of the intermediate transfer belt, wherein the cleaning member is constituted by an elastic rubber blade and is provided with a storage portion for storing waste toner collected from the surface of the intermediate transfer belt by the elastic rubber blade, and the system comprises a tension roller over which the intermediate transfer belt is suspended and that is provided in a position opposed to the elastic rubber blade, and that can move so as to keep a tension of the intermediate transfer belt constant, wherein a cleaning unit is provided in a contact portion of the cleaning member with respect to the surface of the intermediate transfer belt, and the cleaning member is provided in the cleaning unit, and the cleaning unit is divided into at least two, and a portion that is obtained by the division and is provided with the cleaning member is supported by the tension roller and is configured so as to move in accordance with the positional change of the tension roller, and wherein portions that are obtained by dividing the cleaning unit are coupled by an elastic member, and the elastic member is constituted as an expandable coupling member.

2. The intermediate transfer system according to claim 1, wherein a portion that is obtained by dividing the cleaning unit and includes the storage portion is supported by a frame member of an image forming apparatus so that the position is fixed.

3. The intermediate transfer system according to claim 1, wherein a uniformizing member is provided in the cleaning member, and one end of this uniformizing member is positioned in the storage portion for smoothing the upper face of waste toner collected in the storage portion.

4. The intermediate transfer system according to claim 1, wherein the tension roller is supported by a slot formed in a supporting member, and is movable in the direction in which the slot extends, and is provided with an energizing force of a spring for applying a tension to the intermediate transfer belt, and thus the tension roller is configured to make the tension to the intermediate transfer belt whose position is changed in accordance with image forming requirement constant.

5. The intermediate transfer system according to claim 1, wherein the position of the intermediate transfer belt is changed by detachment/contact of the intermediate transfer belt from/with a photoreceptor by movement of a roller for first transfer in accordance with image forming requirement.

6. The intermediate transfer system according to claim 1, wherein the tension roller is constituted by a roller in which at least a distance in which the intermediate transfer belt is in contact with the cleaning member, preferably a distance in which the tension roller extends across the intermediate transfer belt is straight.

7. A method for cleaning an intermediate transfer belt that is performed in the intermediate transfer system according to claim 1, wherein a position of the cleaning member is changed with the positional change of the intermediate transfer belt so that the contact state of the cleaning member with respect to the surface of the intermediate transfer belt is constant regardless of the positional change of the intermediate transfer belt.

* * * * *

UNITED STATES PATENT AND TRADEMARK OFFICE
Certificate

Patent No. 7,392,007 B2 Patented: June 24, 2008

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Kuniaki Nakano, Kyoto (JP); Takahiro Fukunaga, Nara (JP); Susumu Murakami, Kyoto (JP); and Yoshie Iwakura, Osaka (JP).

Signed and Sealed this Twenty-fifth Day of October 2011.

David M. Gray
*Supervisory Patent Examiner*
Art Unit 2852
Technology Center 2800